United States Patent [19]

Bialkowski et al.

[11] Patent Number: 4,593,164

[45] Date of Patent: Jun. 3, 1986

[54] HOUSING OF A VACUUM SWITCHING TUBE

[75] Inventors: Günter Bialkowski; Hans Bettge, both of Berlin, Fed. Rep. of Germany

[73] Assignee: Siemens Aktiengesellschaft, Berlin and Munich, Fed. Rep. of Germany

[21] Appl. No.: 630,967

[22] Filed: Jul. 16, 1984

[30] Foreign Application Priority Data

Jul. 14, 1983 [DE] Fed. Rep. of Germany ..... 3325468

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,355,564 | 11/1967 | Ranheim | 200/144 B |
| 3,700,842 | 10/1972 | Attia | 200/144 B |
| 4,077,114 | 3/1978 | Sakuma | 200/144 B |
| 4,497,990 | 2/1985 | Peche et al. | 200/144 B |

FOREIGN PATENT DOCUMENTS

| | | |
|---|---|---|
| 0017378 | 10/1980 | European Pat. Off. . |
| 2612129 | 11/1978 | Fed. Rep. of Germany . |

*Primary Examiner*—Robert S. Macon

*Attorney, Agent, or Firm*—Herbert L. Lerner; Laurence A. Greenberg

[57] ABSTRACT

A housing of a vacuum switching tube containing switch contacts or contact leads includes at least one insulator having a given temperature coefficient and a connecting surface, at least one non-magnetic metal part having a temperature coefficient differing from the given temperature coefficient, and a magnetic connecting part with a temperature coefficient substantially equal to the given temperature coefficient, the connecting part connecting the metal part to the connecting surface of the insulator with a vacuum-tight joint between the connecting part and the connecting surface of the insulator, the connecting part and metal part having shapes preventing destruction of the vacuum-tight joint under given maximum expected thermal and mechanical stresses, and the connecting part being free of surfaces that can vibrate and transmit vibrations to the environment of the switching tube.

10 Claims, 1 Drawing Figure

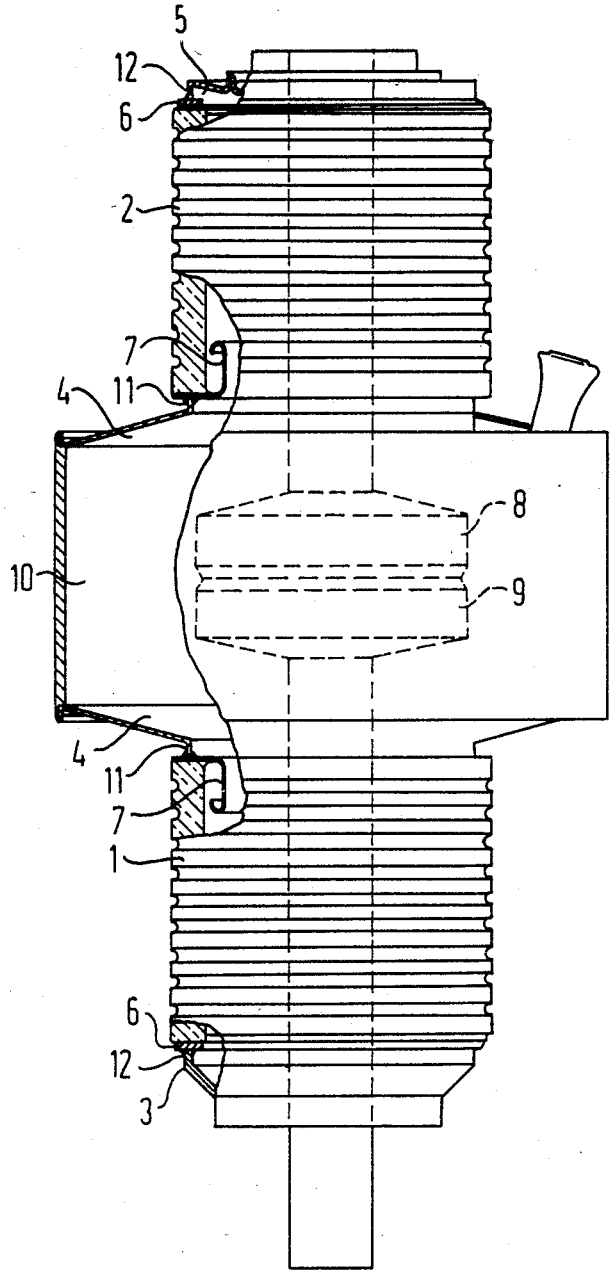
5
12
6
2
7
11
4
8
10
9
4
11
7
1
6
12
3

HOUSING OF A VACUUM SWITCHING TUBE

The present invention relates to a housing of a vacuum switching tube having at least one insulator and one metal part, within which the switch contacts or their leads are installed, the metal part being connected to a connecting surface of the insulator through a connecting part; the connecting part having a temperature coefficient adapted to that of the insulator, the metal part having a temperature coefficient which is not matched to that of the insulator, the connecting part being formed of a magnetic material, and the shapes of the connecting part and the metal part ensure that under the greatest expected thermal and mechanical stresses, no destruction of the vacuum-tight joint between the connecting part and the insulator occurs. Such a housing is known from German Published, Prosecuted Application DE-AS No. 26 12 129. Such housings have a tendency to hum when large currents flow through them, since the alternating magnetic field of the current flowing through the switch contacts sets up vibrations in the parts of the housing which are formed of magnetizable metal, and the vibrations are transmitted as disturbing hum noises to the ambient air through the metallic outer walls of the housing, which are capable of vibrating.

In order to avoid such disturbing hums, Published European Application EP-OS No. 0 017 378 proposes to saturate the metallic parts of the housing of a vacuum switching tube, by magnetically attaching a number of permanent magnets, so far that additional magnetization by the magnetic field of the a-c current flowing in the switch is no longer able to bring the magnetic housing material from the region of magnetic saturation into the steep branch of the corresponding hysterysis loop. According to this publication, a length change of the magnetic material and, therefore, vibration of the housing, is supposed to be avoided. However, these measures require a considerable expense and cannot completely preclude hum in the region of saturation, basically because of the finite slope of the hysterysis loop.

It is accordingly an object of the invention to provide a housing of a vacuum switching tube, which overcomes the hereinafore-mentioned disadvantages of the heretofore-known devices of the general type, which provides a hum-free construction of a vacuum switching tube with a low cost of manufacture, and which can be used over a large temperature range of, for instance, −55° C. to +650° C.

With the foregoing and other objects in view there is provided, in accordance with the invention, a housing of a vacuum switching tube containing switch contacts or contact leads, comprising at least one insulator having a given temperature coefficient and a connecting surface, at least one non-magnetic metal part having a temperature coefficient differing from or not matched to the given temperature coefficient, and a magnetic connecting part with a temperature coefficient substantially equal to or adapted to the given temperature coefficient, the connecting part connecting the metal part to the connecting surface of the insulator with a vacuum-tight joint between the connecting part and the connecting surface of the insulator, the connecting part and metal part having shapes preventing destruction of the vacuum-tight joint under given maximum expected thermal and mechanical stresses, and the connecting part being free of surfaces that can vibrate and transmit or pass on vibrations to the environment of the switching tube.

According to the invention, the only concern is to prevent the connecting part from radiating vibrations to the surrounding air. This objective is met, for instance, if the insulator is tubular and is formed of ceramic, the connecting surface is an end surface of the insulator, the connecting part is a substantially planar circular ring vacuum-tightly brazed to the end surface, the metal part is rotation-symmetrical, and the metal part and the connecting part together form a welded or brazed seam lying on the end face of the insulator.

The connecting part need only have a thickness which is necessary to permit welding to the metal part and which is basically considerably smaller than the wall thickness required for the insulator. The magnetic forces occurring in this very small wall thickness cannot start vibrations or transmit them to the metal part in view of the mounting by the insulator.

In accordance with another feature of the invention, a given part of the connecting part is brazed to the end surface of the insulator, the metal part is a switching chamber, the contacts are in the form of a fixed and a movable contact, movable relative to said fixed contact, disposed in the metal part, and the metal part has two cylindrical edge regions at two sides thereof, the edge regions having end surfaces joined to the connecting part in vicinity of the given part of the connecting part.

In accordance with an additional feature of the invention, the end surfaces of the edge regions are brazed to the connecting part. The cylindrical outer region can be deformed by mechanical or even thermal stresses. It therefore also damps vibrations that might still occur. It additionally has the advantage that the large required useful temperature range is ensured, even if an inexpensive material is chosen for the switching chamber, which has a temperature coefficient that is not matched to that of the insulator.

In accordance with a further feature of the invention there is provided a shielding cylinder formed on the connecting part and completely surrounded by a vacuum. The shielding cylinder can be formed at the connecting part without reducing the freedom from hum. Such a shielding cylinder keeps away metal vapor generated during the switching process from the inside wall of the insulator. While the shielding cylinder can be set in vibration due to the passage of current, it is located in the vacuum and therefore cannot transmit the vibrations to the ambient air. Since only small wall thicknesses for the intermediate part are required in the present invention, such a shielding cylinder also cannot set the ceramic tube in vibration; objectionable hum therefore does not occur in this construction either.

In accordance with again another feature of the invention, there is provided an end cap, the metal part being a flange connecting the end cap to the insulator through the connecting part. The mechanical stresses or vibrations which are to be transmitted by fastening through one of the end caps, are also taken up perfectly by such a housing structure. In this region as well harmful effects of the alternating stress caused by the magnetic field are advantageously prevented.

In accordance with again a further feature of the invention, the connecting part is formed of a CONiFE alloy and the insulator is formed of $Al_2O_3$ ceramic.

In accordance with still an additional feature of the invention, the connecting part is formed of NiCO2918. A NiCo2918 alloy is formed of 29% nickel, 18% cobalt and the remainder iron. These metals are joined to the $Al_2O_3$ ceramic preferably used for the insulator; they have approximately the same temperature coefficient as the ceramic.

In accordance with a concomitant feature of the invention, the metal part is formed of CuNi30. CuNi30 is formed of 30% nickel and the remainder copper. This material is nonmagnetic and non-rusting, so that the use of a surface protection can be dispensed with if this material is used.

Other features which are considered as characteristic for the invention are set forth in the appended claims.

Although the invention is illustrated and described herein as embodied in a housing of a vacuum switching tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic, partially cross-sectional and broken-away view of a vacuum switching tube according to the invention.

Referring now to the FIGURE of the drawing in detail, it is seen that the housing of the vacuum switching tube contains insulators 1, 2, which are preferably formed of $Al_2O_3$ ceramic, and metal parts 3, 4, 5 which are formed of a non-magnetic material. The metal parts 3, 4, 5 are welded or brazed to a connecting part 6 or 7, respectively. The connecting parts 6 and 7 are each respectively brazed to an end face of one of the insulators 1 and 2. The connecting parts 6 and 7 are formed of a CoNiFe alloy, the temperature coefficient of which is matched to that of the insulators, and preferably they are formed of NiCo2918. These connecting parts are brazed to the insulators in a conventional manner.

The housing part 4 is formed by the switching chamber of the switching tube. The part 4 can be formed of several individual parts and, for instance, may be a welded structure. The housing part 4 has a cylindrical outer region 11 in vicinity of the end faces thereof. The end faces of the cylindrical outer region 11 are brazed or welded to the region of the respective connecting part 7 which is brazed to the end face of one of the tubular insulators 1 and 2, respectively. The cylindrical outer regions 11 have a wall thickness which is as small as possible; they can be deformed slightly in the radial direction and, therefore, contribute to damping vibrations which still might occur. At the same time, they are suitable for taking up differences in the change in diameter of the insulators 1 and 2 relative to the metal part 4 in the event of temperature changes, so that a relatively inexpensive material which is not matched to the temperature coefficients of the insulators 1 or 2 can be used for the metal parts 4. The same applies to the cylindrical outer regions 12 of the metal parts 3 and 5 which are constructed as flanges.

Shielding cylinders are formed on the connecting parts 7 which adjoin the switching chamber 10. The shielding cylinders are located completely in the vacuum. These shielding cylinders prevent the formation of a deposit of metal on the inside of the insulators 1 and 2, if the switch is opened through movement of a movable contact 9 in the direction of the arrow causing metal vapor to be liberated due to the arc generated in the process.

When switch contacts 8 or 9 are closed, a considerable contact pressure is generated which must compensate the repelling current forces. Vibrations occurring at the switch contacts 8, 9 caused by the current forces can be controlled in a particularly advantageous manner by the structure of the housing, because the thermal coefficient of expansion of the insulators need not be taken into consideration in the selection of the materials for the flanges and because additional stress caused by magnetically generated vibrations does not occur.

The foregoing is a description corresponding in substance to German Application No. P 33 25 468.0, dated July 14, 1983, the International priority of which is being claimed for the instant application, and which is hereby made part of this application. Any material discrepancies between the foregoing specification and the aforementioned corresponding German application are to be resolved in favor of the latter.

We claim:

1. Housing of a vacuum switching tube containing switch contacts or contact leads, comprising at least one insulator having a given temperature coefficient and a connecting surface, a non-magnetic metal switching chamber surrounding the contacts or contact leads having a temperature coefficient differing from said given temperature coefficient, and a magnetic connecting part with a temperature coefficient substantially equal to said given temperature coefficient, said connecting part connecting said metal part to said connecting surface of said insulator with a vacuum-tight joint between said connecting part and said connecting surface of said insulator, said connecting part and metal part having shapes preventing destruction of said vacuum-tight joint under given maximum expected thermal and mechanical stresses, and said connecting part being free of surfaces than can vibrate and transmit vibrations to the environment of the switching tube.

2. Housing according to claim 1, wherein said connecting part is formed of a CONiFE alloy and said insulator is formed of $Al_2O_3$ ceramic.

3. Housing according to claim 2, wherein said connecting part is formed of NiCO2918.

4. Housing according to claim 1, wherein said switching chamber is formed of CuNi30.

5. Housing of a vacuum switching tube containing switch contacts or contact leads, comprising at least one tubular ceramic insulator having a given temperature coefficient and an end surface, at least one non-magnetic rotation-symmetrical metal part in the form of a switching chamber surrounding the contacts or contact leads having a temperature coefficient differing from said given temperature coefficient, and a magnetic connecting part in the form of a substantially planar circular ring with a temperature coefficient substantially equal to said given temperature coefficient, said connecting part connecting said metal part to said end surface of said insulator with a vacuum-tight brazed joint between said connecting part and said end surface of said insulator and a welded seam between said metal part and said connecting part, said connecting part and metal part having shapes preventing destruction of said vacuum-tight joint under given maximum expected thermal and mechanical stresses, and said connecting part being free of surfaces that can vibrate and transmit vibrations to the environment of the switching tube.

6. Housing according to claim 5, wherein a given part of said connecting part is brazed to said end surface of said insulator, the contacts are in the form of a fixed and a movable contact disposed in said metal part, and said metal part has two cylindrical edge regions at two sides thereof, said edge regions having end surfaces joined to said connecting part in vicinity of said given part of said connecting part.

7. Housing according to claim 6, wherein said end surfaces of said edge regions are brazed to said connecting part.

8. Housing according to claim 6, wherein said end surfaces of said edge regions are welded to said connecting part.

9. Housing according to claim 5, including a shielding cylinder formed on said connecting part and surrounded by a vacuum.

10. Housing of a vacuum switching tube containing switch contacts or contact leads, comprising at least one tubular ceramic insulator having a given temperature coefficient and an end surface, at least one non-magnetic rotation-symmetrical metal part in the form of a flange partly covering the contacts or contact leads having a temperature coefficient differing from said given temperature coefficient, and a magnetic connecting part in the form of a substantially planar circular ring with a temperature coefficient substantially equal to said given temperature coefficient, said connecting part connecting said metal part to said end surface of said insulator with a vacuum-tight brazed joint between said connecting part and said end surface of said insulator and a welded seam between said metal part and said connecting part, said connecting part and metal part having shapes preventing destruction of said vacuum-tight joint under given maximum expected thermal and mechanical stresses, and said connecting part being free of surfaces that can vibrate and transmit vibrations to the environment of the switching tube.

* * * * *